US006123199A

United States Patent [19]

Madsen

[11] Patent Number: 6,123,199

[45] Date of Patent: Sep. 26, 2000

[54] PACKAGING ELEMENT IN THE FORM OF AN INTEGRALLY MOULDED ENCASEMENT PIECE OF A PULP MATERIAL

[75] Inventor: Steen Ulrik Madsen, Gentofte, Denmark

[73] Assignee: Brodrene Hartman A/S, Lyngby, Denmark

[21] Appl. No.: 09/284,796

[22] PCT Filed: Oct. 27, 1997

[86] PCT No.: PCT/DK97/00471

§ 371 Date: Apr. 21, 1999

§ 102(e) Date: Apr. 21, 1999

[87] PCT Pub. No.: WO98/23501

PCT Pub. Date: Jun. 4, 1998

[30] Foreign Application Priority Data

Nov. 22, 1996 [DK] Denmark ..... 1339/96

[51] Int. Cl.[7] ..... B65D 81/113

[52] U.S. Cl. ..... 206/586; 206/594

[58] Field of Search ..... 206/453, 521, 206/586, 587, 588, 591, 594; 229/406, 407

[56] References Cited

U.S. PATENT DOCUMENTS

| | | | |
|---|---|---|---|
| 1,985,050 | 5/1934 | Koppelman | 206/594 |
| 2,863,595 | 12/1958 | Emery . | |
| 2,941,708 | 6/1960 | Crane et al. | 229/406 |
| 3,651,976 | 3/1972 | Chadbourne | 229/406 |
| 3,926,363 | 12/1975 | Carlton | 229/406 |
| 4,006,818 | 2/1977 | Wannyn . | |
| 5,127,526 | 7/1992 | Vigue | 206/587 |
| 5,713,619 | 2/1998 | DuBois et al. | 229/406 |

FOREIGN PATENT DOCUMENTS

| | | |
|---|---|---|
| 40 39 572 | 8/1991 | Germany . |
| 196 38 096 | 7/1997 | Germany . |
| 94/06704 | 3/1994 | WIPO . |
| 95/08485 | 3/1995 | WIPO . |

*Primary Examiner*—Jim Foster
*Attorney, Agent, or Firm*—Larson & Taylor plc

[57] ABSTRACT

A packaging element in the form of an integrally molded encasement piece in the form of a shell of pulp material is produced through forming by suction a layer of a suspension of pulp whilst maintaining a draught angle on a porous mold for forming the piece. Removal of the piece from the mold and subsequent drying of the piece produce a finished element intended and designed to surround, embrace and support a free side region or end region of a mainly box-shaped article in an external shipping or presentation packaging. The packaging element has a substantially rectangular base surface of substantially the same shape and dimensions as a side surface or end surface of a side region or an end region of the article to be packaged. The shell includes, at least along two oppositely situated edges of the base surface, outwardly protruding side walls that are integrally formed with the base surface and that along each of the side edges thereof are connected to side walls protruding outwardly from the base surface along other edges of the latter. Each of the side walls has a gap extending from the uppermost margin of the side wall in two wall portions with such a distance between their edges, that the wall portions can, while the gap is being narrowed, be bent against each other about a flexure axis defined in the base surface and extending between the two side walls suitably modified.

10 Claims, 5 Drawing Sheets

PACKAGING ELEMENT IN THE FORM OF AN INTEGRALLY MOULDED ENCASEMENT PIECE OF A PULP MATERIAL

TECHNICAL FIELD

The invention relates to a packaging element in the form of an integrally moulded encasement piece in the form of a shell of pulp material produced through forming by suction a layer of a pulp suspension, whilst maintaining a draught angle on a porous mould for forming the piece, removal of the piece from the mould and subsequent drying of the piece to produce a finished element intended and designed to surround, embrace and support a free side region or end region of a mainly box-shaped article in an external shipping or presentation packaging.

BACKGROUND ART

Packaging elements of the kind referred to are used to surround and support free side regions or end regions of mainly box-shaped articles, and in the finished package they are embraced by an external shipping or presentation packaging element, e.g. in the form of a pre-fabricated case, box or envelope. Such a packaging element is known from WO 94/06704.

If the packaging elements are manufactured of a material such as expandable polystyrene, it is possible to finalize the elements almost without a draught angle, thus achieving practically full contact with the-article to one side and with the external packaging to the other side.

Within the conventional pulp-moulding method being used especially for manufacturing large numbers of packaging elements, it is required that a draught angle is maintained, at least during the moulding process so that the walls are clearing. A typical value of this angle lies in an order of magnitude of 8°. This means that a packaging element of the kind set forth, manufactured by moulding a pulp material, will not come into full abutment, especially against the external, relatively thin shipping or presentation packaging.

BRIEF SUMMARY OF THE INVENTION

It is the object of the invention to provide a packaging element that is well-suited for manufacture using the conventional pulp-moulding method and having such a shape, that it is also possible to abut to the full extent against an external shipping or presentation packaging surrounding the package article.

According to the invention, this object is achieved by means of the construction of the packaging element as set forth hereafter.

The incisions make it possible to press said side-wall parts towards each other whilst narrowing the incision, which means that even the other side walls connected at an angle with these side-wall parts can be pressed inwardly in the shell whilst reducing or completely eliminating their angular position determined by the draught angle. This provides the prerequisite for a full abutment, both internally and externally.

An advantageous embodiment thereof of the invention has the width of the incision sufficient to compensate for twice the draught angle used during moulding.

Another advantageous embodiment, especially for use with long side walls, has two parallel incision.

The flexure axis in the base surface is preferably a flexure line, or a series of line segments.

Also preferably, at least two opposite side walls have inwardly facing portions for abutment against a side region or end region of the article and outwardly facing portions for abutment against the external shipping or presentation packaging which may be provided by using the conventional pulp-moulding method within the scope of the invention.

In a preferred embodiment, the outwardly facing portions are hollow, downwardly facing truncated pyramids having at least one freely protruding outer-wall surface, providing an advantageous embodiment for providing an external packaging abutment surface that can also be utilized as a guide surface for a packaging envelope.

Further, each pyramid makes it possible to provide useful supporting legs.

Disposing incisions in all side walls provides an embodiment for packaging elements of large dimensions, and stop knobs on the base surface of side walls provide measures for counteracting an inappropiately forceful pressing of the side walls against each other.

BRIEF DESCRIPTION OF THE DRAWINGS

In the following, the invention will be explained in more detail with reference to the drawings, in which.

DESCRIPTION OF THE PREFERRED EMBODIMENTS

Figure 1:
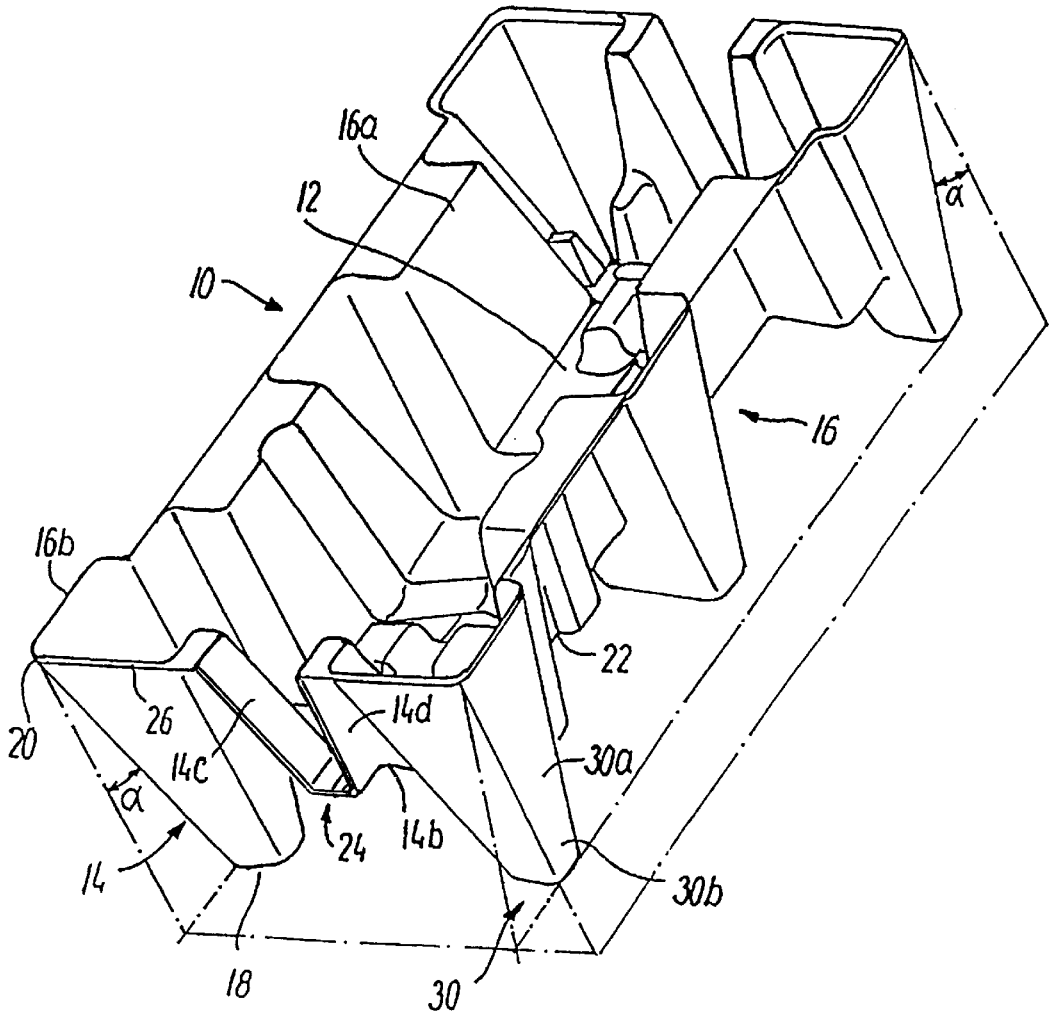
FIG. 1 is a side view in perspective of an embodiment of the packaging element according to the invention, as viewed sideways and obliquely from above.
Figure 2:
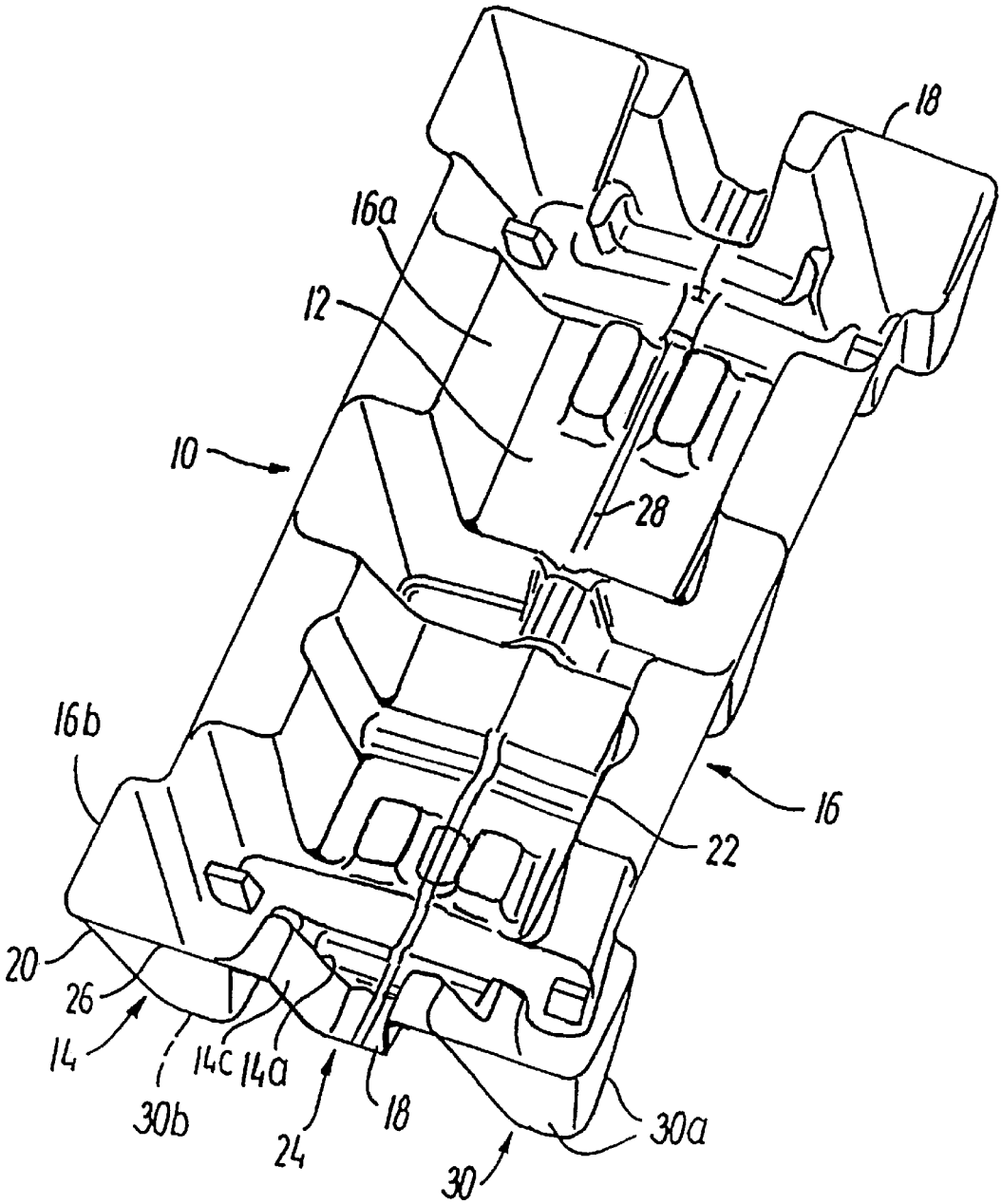
FIG. 2 shows the same as viewed from above.
Figure 3:
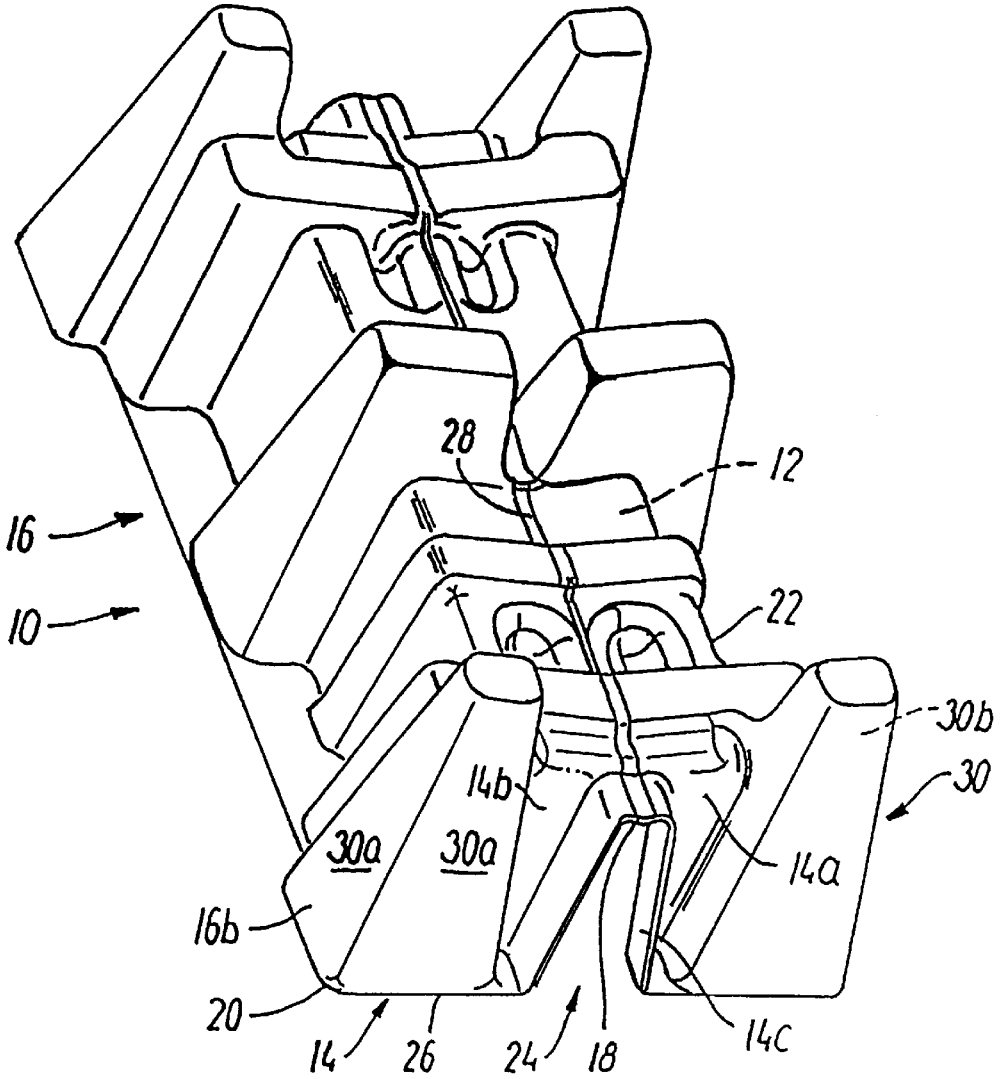
FIG. 3 shows the same as viewed from below, FIG. 4 diagramatically shows a second embodiment.

FIGS. 1–3 show an embodiment of a packaging element in the form of an integrally moulded encasement piece constituted by a shell 10 of pulp material. The shell has a substantially rectangular base surface 12. The latter has substantially the same shape and dimensions as a side surface or end surface of a side region or an end region of an article to be packaged.

Figure 7A:
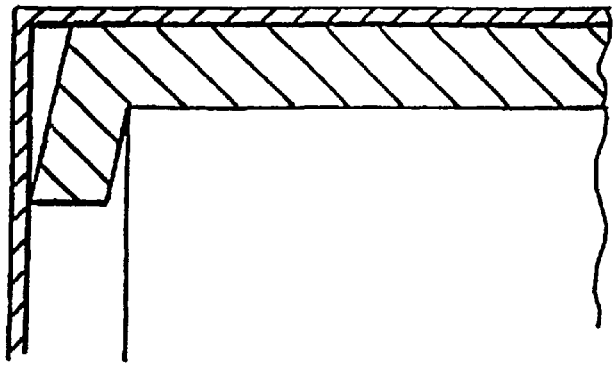
Figure 7B:
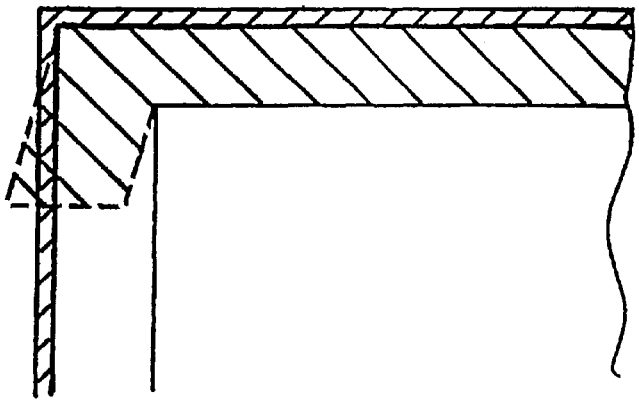
Figure 7C:
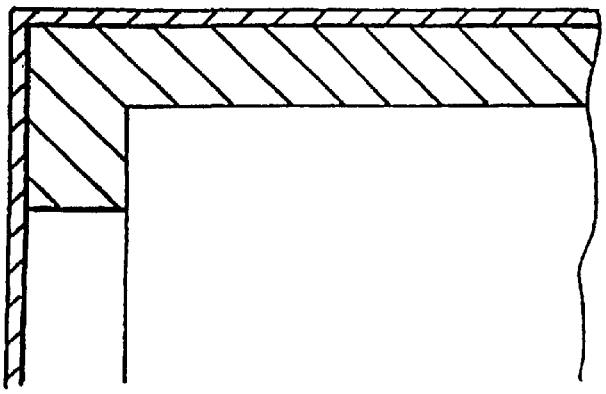

Along it edges, the base surface 12 comprises side walls 14 and 16 lying opposite to each other in pairs (14–14 and 16–16). The base surface 12 and the side walls 14 and 16 are integrally moulded in pulp material through forming by suction a layer of a pulp-material suspension onto a porous mould whilst maintaining a draught angle $\alpha$ of the order of magnitude 8° from the side walls 14 and 16 as indicated in FIG. 7. The finished element is removed from the mould—e.g. by blowing it off—and is dried. The dried element will substantially retain the shape determined by the draught angle.

The element 10 is designed and shaped so as to be able to embrace and support a free side region or end region (not shown) of a mainly box-shaped article in another external shipping or presentation packaging means embracing the element 10 in the finished package, e.g. in the form of a case, box or envelope.

For the mere purpose of definition the terms "up", "down", "upwardly" and "upright" have been used in accordance with the packaging element in its position as shown in FIGS. 1 and 2. These terms have in this description and in the claims no relation to the orientation with respect to the terrestrial gravitation.

According to the invention, side walls 14 formed integrally with the base surface 12 and extending along two oppositely situated edges 18 of the latter protrude upwardly in a draught-angle position, said side walls 14 along each of their outer marginal edges 20 being connected to side walls 16 extending upwardly and along the other edges 22 of the base surface 12. Each side wall 14 has an incision 24 extending down from the upper marginal edge 26 of the side wall to the base surface 12 and dividing each side wall into two wall portions 14*a* and 14*b* with such a distance between the margins 14*c* and 14*d* of the incision, that the wall portions 14*a* and 14*b* can be bent towards each other around a flexure axis 28 defined in the base surface 12 and extending between the two side walls 14, so as to reduce the width of the incision 24.

This makes it possible to bend the side walls 16 around the flexure axis 28 from the draught-angle position to an upright position as shown with full lines in FIG. 7, so that internally they can lie in close abutment against an upright side wall of the article to be packed, and externally, they can with certainty have full contact with an external embracing packaging element.

The incision 24 has a width so as at least to compensate for twice the draught angle.

As will especially be evident from FIG. 2, the flexure axis 28 is formed in an auxilliary line divided into a number of lengths for controlling the flexing movements arising in the base surface 12 when the side walls 16 are bent towards each other.

The side walls 16 of the element comprises inwardly facing portions 16*a* for abutment against side regions or end regions of the article, as well as outwardly facing portions 16*b* for abutment against an external embracing packaging element, with a force retaining the packaged article.

The outwardly facing portions are in the form of truncated pyramids 30 protruding freely with at least one outer wall surface 30*a*. In addition, the truncated pyramids have such a length that they constitute downwardly protruding supporting legs 30*b*.

Figure 4:
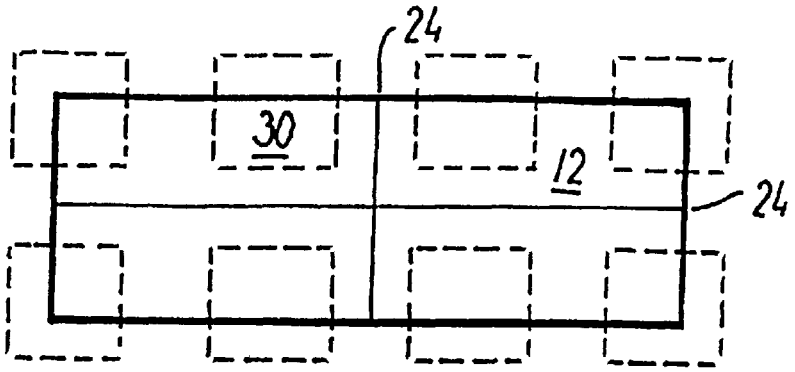
Figure 5:
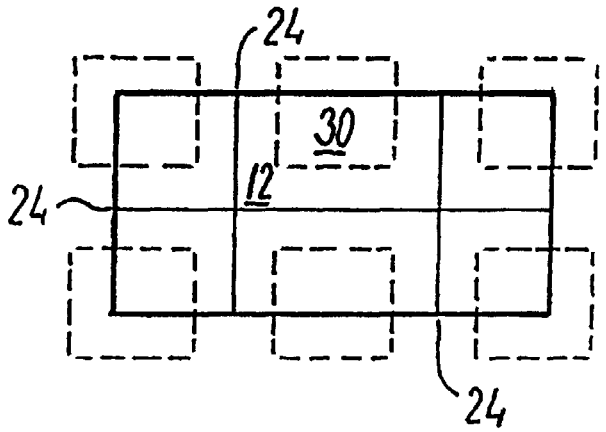
FIG. 5 shows a third embodiment.
Figure 6:
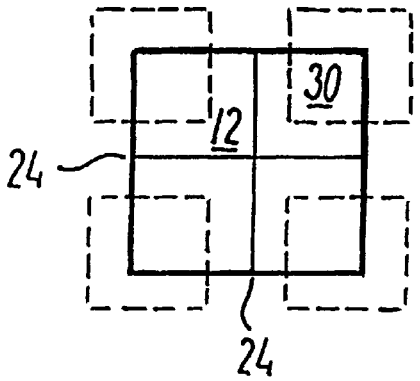
FIG. 6 shows a fourth embodiment and FIG. 7 diagramatically shows a cut from a functional sketch.

As shown in FIGS. 4, 5 and 6, a number of incisions 24 may be situated in some or all of the side walls 14 and 16 of the base surface 12.

Stop knobs (not shown) can be formed on the base surface or on the side walls or on both, said knobs being adapted to by abutment to limit the relative angular of movement of the parts when the side walls are bent into an upright position.

What is claimed is:

1. A packaging element which forms a shell intended and designed to surround, embrace and support a free side region or end region of a mainly box-shaped article in an external shipping or presentation packaging, said packaging element comprising:

a substantially rectangular base surface of substantially the same shape and dimensions as a side surface or end surface of a side region or an end region of the article to be packaged;

respective opposite first side walls integrally formed with said base surface at two respective oppositely situated first edges of said base surface and extending upwardly therefrom;

respective opposite second side walls integrally formed with said base surface at two respective oppositely situated second edges of said base surface and extending upwardly therefrom, said respective second side walls being respectively connected to said first side walls to form respective upper extending edges at intersections therewith;

an incision provided in said opposite first side walls, said incision extending from an uppermost marginal edge of each of said first side walls down towards said base surface so as to divide each of first said side walls into respective adjacent wall portions, said incision having a width which allows a relative angular movement of respective said adjacent wall portions towards each other while said base surface is bent around a flexure axis in said base surface extending between respective said incisions.

2. A packaging element as claimed in claim 1:

wherein said second side walls are formed at a draught angle relative to said base; and wherein the width of said incision allows an angular movement of said first side walls equal to at least twice the draught angle.

3. A packaging element as claimed in claim 1, and further including a second incision provided in said opposite first side walls and disposed parallel to said first-mentioned incision, said second incision extending from the uppermost marginal edge of each one of said first side walls down towards said base surface so as to additionally divide each of said first side walls into respective second adjacent wall portions, said second incision having a width which allows a relative angular movement of respective said second adjacent wall portions towards each other while said base surface is additionally bent around a second flexure axis in said base surface extending between respective said second incisions.

4. A packaging element as claimed in claim 1, wherein said flexure axis is formed as a line in said base surface.

5. A packaging element as claimed in claim 1, wherein said line of said flexure axis formed in said base surface is a series of line segments.

6. A packaging element as claimed in claim 1, wherein said second side walls have integrally formed (a) inwardly facing portions for abutment against a side region or end region of the article and (b) outwardly facing portions for abutment against the external shipping or presentation packaging with such a force that said inwardly facing portions can be pressed in a retaining manner against the side region or end region of the article by the shipping or presentation packaging.

7. A packaging element as claimed in claim 6, wherein said outwardly facing portions are hollow, downwardly facing truncated pyramids having at least one freely protruding outer-wall surface.

8. A packaging element as claimed in claim 7, wherein each said downwardly facing truncated pyramid includes a downwardly protruding supporting leg.

9. A packaging element as claimed in claim 6, and further including a second incision provided in said opposite second side walls, said second incision extending from the uppermost marginal edge of each one of said second side walls down towards said base surface so as to divide each of said second side walls into respective second adjacent wall portions, said second incision having a width which allows a relative angular movement of respective said second adjacent wall portions towards each other while said base surface is additionally bent around a second flexure axis in said base surface extending between respective said second incisions.

10. A packaging element as claimed in claim 1, and further including a second incision provided in said opposite second side walls, said second incision extending from the uppermost marginal edge of each one of said second side walls down towards said base surface so as to divide each of said second side walls into respective second adjacent wall portions, said second incision having a width which allows a relative angular movement of respective said second adjacent wall portions towards each other while said base surface is additionally bent around a second flexure axis in said base surface extending between respective said second incisions.

* * * * *